US009142879B2

(12) United States Patent
Galeev

(10) Patent No.: US 9,142,879 B2
(45) Date of Patent: Sep. 22, 2015

(54) WIRELESS ELECTRONIC DEVICES WITH A METAL PERIMETER INCLUDING A PLURALITY OF ANTENNAS

(71) Applicant: Sony Mobile Communications AB, Lund (SE)

(72) Inventor: Roustem Galeev, Lund (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 338 days.

(21) Appl. No.: 13/675,023

(22) Filed: Nov. 13, 2012

(65) Prior Publication Data

US 2014/0132457 A1 May 15, 2014

(51) Int. Cl.

| | |
|---|---|
| ***H01Q 1/24*** | (2006.01) |
| ***H01Q 1/48*** | (2006.01) |
| ***H01Q 9/04*** | (2006.01) |
| ***H01Q 9/42*** | (2006.01) |
| ***H01Q 13/10*** | (2006.01) |
| ***H01Q 21/30*** | (2006.01) |
| ***H01Q 5/35*** | (2015.01) |
| *H01Q 1/52* | (2006.01) |

(52) U.S. Cl.

CPC ..... *H01Q 1/243* (2013.01); *H01Q 1/48* (2013.01); *H01Q 5/35* (2015.01); *H01Q 9/0442* (2013.01); *H01Q 9/42* (2013.01); *H01Q 13/103* (2013.01); *H01Q 21/30* (2013.01); *H01Q 1/521* (2013.01)

(58) Field of Classification Search

USPC ..... 343/702, 866, 867

See application file for complete search history.

(56) References Cited

U.S. PATENT DOCUMENTS

| | | | | |
|---|---|---|---|---|
| 8,169,374 | B2 * | 5/2012 | Hill et al. | 343/702 |
| 8,750,949 | B2 * | 6/2014 | Merz et al. | 455/575.7 |
| 8,907,853 | B2 * | 12/2014 | Ying | 343/702 |
| 2011/0001673 | A1 | 1/2011 | You et al. | |
| 2012/0157175 | A1 | 6/2012 | Golko et al. | |

FOREIGN PATENT DOCUMENTS

| | | | |
|---|---|---|---|
| CN | 102368575 | A | 3/2012 |
| CN | 102684722 | A | 9/2012 |
| CN | 102983405 | A | 3/2013 |
| EP | 2 498 336 | A2 | 9/2012 |

OTHER PUBLICATIONS

European Search Report Corresponding to European Application No. 13188097.3, Dated: Feb. 21, 2014; 8 Pages.

Chinese Office Action Corresponding to Chinese Application No. 201310472716.7, Mailing Date: Jul. 1, 2015; Foreign Text, 7 Pages, English Translation Thereof, 10 pages.

* cited by examiner

*Primary Examiner* — Tan Ho

(74) *Attorney, Agent, or Firm* — Myers Bigel Sibley & Sajovec, PA

(57) ABSTRACT

Wireless electronic devices may include a ground plane and a metal perimeter around the ground plane. The metal perimeter may include a plurality of antennas and may provide a front surface and/or edge surfaces of the wireless electronic devices.

17 Claims, 8 Drawing Sheets

WIRELESS ELECTRONIC DEVICES WITH A METAL PERIMETER INCLUDING A PLURALITY OF ANTENNAS

FIELD

The present inventive concepts generally relate to the field of communications and, more particularly, to antennas and wireless electronic devices incorporating the same.

BACKGROUND

Wireless electronic devices may include insulators between nearby antennas to reduce antenna interference. Such insulators may be exposed to users of the wireless electronic devices, however, and may therefore provide a discontinuous look and/or feel to the exterior of the wireless electronic devices.

SUMMARY

Various embodiments of the present inventive concepts include wireless electronic devices. The wireless electronic devices may include a ground plane and a metal perimeter around the ground plane. The metal perimeter may include first and second antennas that are physically connected to each other along/in the metal perimeter by metal.

In various embodiments, the first antenna may include a metal outer surface that physically contacts a metal outer surface of the second antenna.

According to various embodiments, the first and second antennas may include first and second half-loop antennas, respectively.

In various embodiments, the metal outer surface of the first half-loop antenna may contact the metal outer surface of the second half-loop antenna to provide (e.g., to collectively define) a continuously metal combined metal outer surface.

According to various embodiments, the continuously metal combined metal outer surface may include only metal.

In various embodiments, the metal perimeter may include a metal front outer surface of the wireless electronic devices. The metal front outer surface may include the first and second antennas.

According to various embodiments, the metal front outer surface may be spaced apart from the ground plane.

In various embodiments, the wireless electronic devices may include a backplate and outer surface edges around the ground plane. The backplate and the metal front outer surface may be separated by the outer surface edges.

According to various embodiments, the wireless electronic devices may include a first transceiver circuit coupled to the first antenna and configured to provide communications for the wireless electronic devices, a first antenna matching circuit connected to the first transceiver circuit, a second transceiver circuit coupled to the second antenna and configured to provide communications for the wireless electronic devices, a second antenna matching circuit connected to the second transceiver circuit, and a third antenna matching circuit connected to the first and/or second antennas and bypassing the first and second transceiver circuits.

In various embodiments, the metal perimeter may include a third antenna. At least one of the first and third antennas may include a cellular antenna, and the second antenna may include a non-cellular antenna.

According to various embodiments, the metal perimeter may include a slot that provides an opening for a button and/or an input/output component of the wireless electronic devices. The slot may be completely surrounded by a metal of the metal perimeter.

In various embodiments, the slot may be one slot among a plurality of slots in the metal perimeter. The metal perimeter may be continuously metal except for the plurality of slots.

Wireless electronic devices according to various embodiments may include a ground plane and a metal front outer surface including a metal perimeter around and spaced apart from the ground plane. The metal perimeter may include first and second antennas. The wireless electronic devices may include a transceiver circuit coupled to at least one of the first and second antennas and configured to provide communications for the wireless electronic devices.

In various embodiments, the wireless electronic devices may include a backplate and outer surface edges around the ground plane. The backplate and the metal front outer surface may be separated by the outer surface edges.

According to various embodiments, the wireless electronic devices may include a switchable ground connection configured to switchably couple the ground plane and one of the first and second antennas to adjust a length of the one of the first and second antennas.

In various embodiments, the first and second antennas may include first and second half-loop antennas, respectively.

According to various embodiments, the metal perimeter of the metal front outer surface may include a third antenna.

In various embodiments, an end portion of the metal perimeter of the metal front outer surface may be spaced apart from an adjacent end portion of the ground plane by about 4.0 mm, and a side portion of the metal perimeter of the metal front outer surface may be spaced apart from an adjacent side portion of the ground plane by about 1.5 mm.

Wireless electronic devices according to various embodiments may include a ground plane and a metal front outer surface including a metal perimeter around and spaced apart from the ground plane. The metal perimeter may include a plurality of half-loop antennas, which may include first and second half-loop antennas that are physically connected to each other along/in the metal perimeter by metal. The wireless electronic devices may include a transceiver circuit coupled to at least one of the plurality of half-loop antennas and configured to provide communications for the wireless electronic devices.

In various embodiments, the first half-loop antenna may include a metal outer surface that physically contacts a metal outer surface of the second half-loop antenna to provide (e.g., to collectively define) a continuously metal combined metal outer surface in/along the metal front outer surface.

Other devices and/or systems according to embodiments of the inventive concepts will be or become apparent to one with skill in the art upon review of the following drawings and detailed description. It is intended that all such additional devices and/or systems be included within this description, be within the scope of the present inventive concepts, and be protected by the accompanying claims. Moreover, it is intended that all embodiments disclosed herein can be implemented separately or combined in any way and/or combination.

DETAILED DESCRIPTION OF EMBODIMENTS

Figure 1:
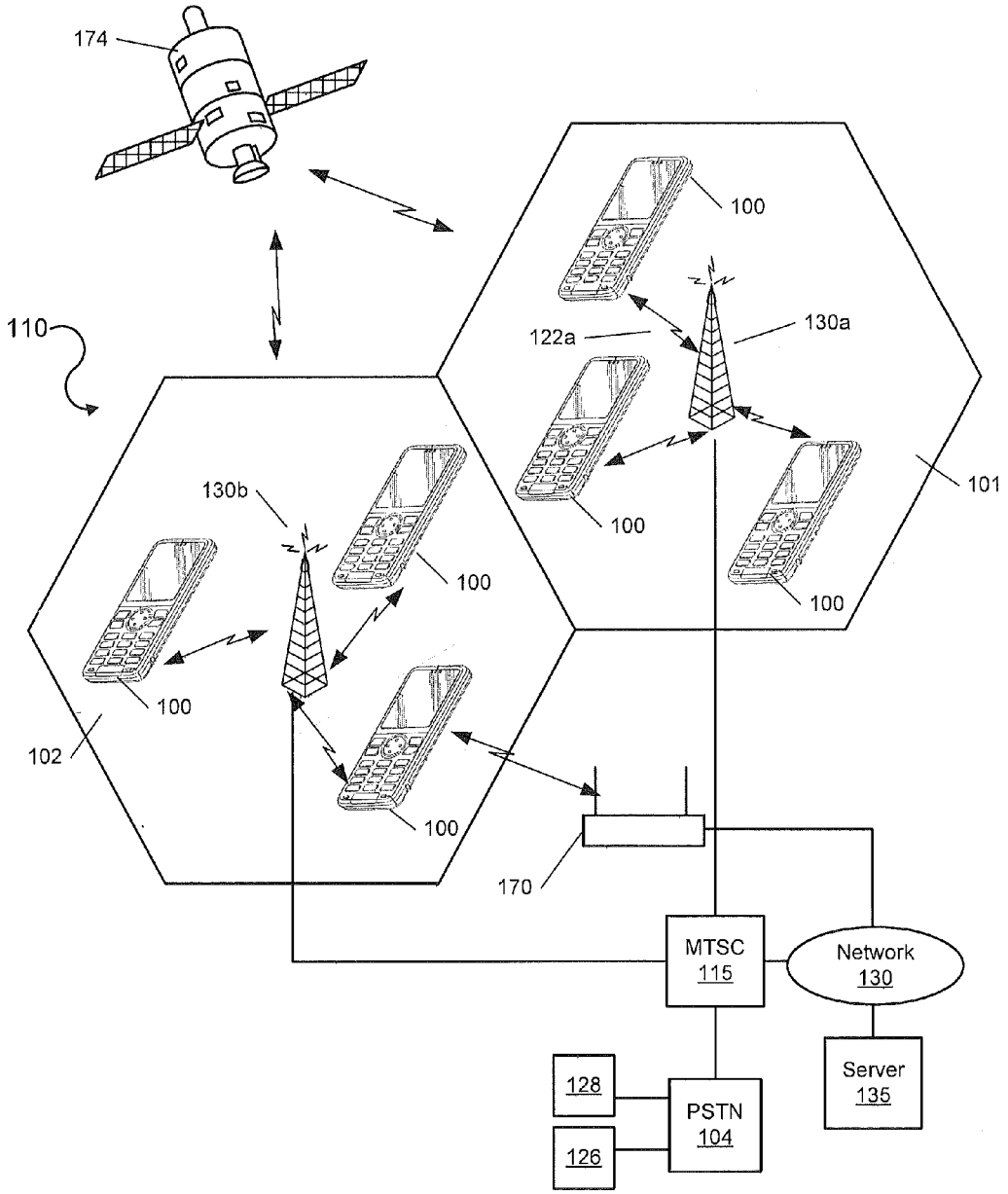
FIG. 1 is a schematic illustration of a wireless communications network that provides service to wireless electronic devices, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein the term "and/or" includes any and all combinations of one or more of the associated listed items.

Spatially relative terms, such as "above," "below," "upper," "lower," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concepts are described herein in the context of "wireless electronic devices." Among other devices/systems, wireless electronic devices may include multi-band wireless communication terminals (e.g., portable electronic devices/wireless terminals/mobile terminals/terminals) that are configured to carry out cellular communications (e.g., cellular voice and/or data communications) in more than one frequency band. It will be understood, however, that the present inventive concepts are not limited to such embodiments and may be embodied generally in any device and/or system that is configured to transmit and receive in one or more frequency bands. Moreover, the terms "about" and "substantially," as described herein, mean that the recited number or value can vary by +/−25%.

Exposed insulators along an exterior of a conventional wireless electronic device may provide a discontinuous look and/or feel. Moreover, although conventional wireless electronic devices may include a front metal frame around an active area of a display screen, the front metal frame may be a part of (e.g., may not be separated from) a chassis/ground plane of the wireless electronic devices and may thus provide a relatively weak configuration for an antenna system. Various embodiments of the wireless electronic devices described herein, however, may include a metal perimeter that includes a plurality of antennas. Adjacent antennas in the metal perimeter may physically contact each other to provide a continuous metal outer surface. Additionally or alternatively, a front metal frame may be spaced apart from a wireless electronic device chassis/ground plane and may include the metal perimeter that includes the plurality of antennas. Accordingly, various embodiments described herein may provide a smoother, more continuous look and/or feel to the exterior of a wireless electronic device, and/or may use a front metal frame as a multi-band antenna system with good performance characteristics.

Referring to FIG. 1, a diagram is provided of a wireless communications network 110 that supports communications in which wireless electronic devices 100 can, be used according to various embodiments of the present inventive concepts. The network 110 includes cells 101, 102 and base stations 130*a*, 130*b* in the respective cells 101, 102. Networks 110 are commonly employed to provide voice and data communications to subscribers using various radio access standards/technologies. The network 110 may include wireless electronic devices 100 that may communicate with the base stations 130*a*, 130*b*. The wireless electronic devices 100 in the network 110 may also communicate with a Global Positioning System (GPS) satellite 174, a local wireless network 170, a Mobile Telephone Switching Center (MTSC) 115, and/or a Public Service Telephone Network (PSTN) 104 (i.e., a "landline" network).

The wireless electronic devices 100 can communicate with each other via the Mobile Telephone Switching Center (MTSC) 115. The wireless electronic devices 100 can also communicate with other devices/terminals, such as terminals 126, 128, via the PSTN 104 that is coupled to the network 110. As also shown in FIG. 1, the MTSC 115 is coupled to a computer server 135 via a network 130, such as the Internet.

The network 110 is organized as cells 101, 102 that collectively can provide service to a broader geographic region. In particular, each of the cells 101, 102 can provide service to associated sub-regions (e.g., regions within the hexagonal areas illustrated by the cells 101, 102 in FIG. 1) included in the broader geographic region covered by the network 110. More or fewer cells can be included in the network 110, and the coverage area for the cells 101, 102 may overlap. The shape of the coverage area for each of the cells 101, 102 may be different from one cell to another and is not limited to the hexagonal shapes illustrated in FIG. 1. Each of the cells 101, 102 may include an associated base station 130*a*, 130*b*. The base stations 130*a*, 130*b* can provide wireless communications between each other and the wireless electronic devices 100 in the associated geographic region covered by the network 110.

Each of the base stations 130*a*, 130*b* can transmit/receive data to/from the wireless electronic devices 100 over an associated control channel For example, the base station 130*a* in cell 101 can communicate with one of the wireless electronic devices 100 in cell 101 over the control channel 122*a*. The control channel 122*a* can be used, for example, to page the wireless electronic device 100 in response to calls directed thereto or to transmit traffic channel assignments to the wireless electronic device 100 over which a call associated therewith is to be conducted.

The wireless electronic devices 100 may also be capable of receiving messages from the network 110 over the respective control channels 122*a*. In various embodiments according to the inventive concepts, the wireless electronic devices 100 receive Short Message Service (SMS), Enhanced Message Service (EMS), Multimedia Message Service (MMS), and/or Smartmessaging™ formatted messages.

The GPS satellite 174 can provide GPS information to the geographic region including cells 101, 102 so that the wireless electronic devices 100 may determine location information. The network 110 may also provide network location information as the basis for the location information applied by the wireless electronic devices 100. In addition, the location information may be provided directly to the server 135 rather than to the wireless electronic devices 100 and then to the server 135. Additionally or alternatively, the wireless electronic devices 100 may communicate with the local wireless network 170.

Figure 2A:
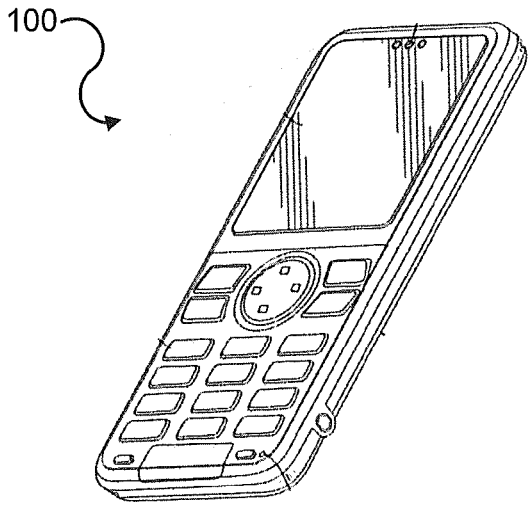
FIGS. 2A and 2B illustrate front and rear views, respectively, of a wireless electronic device, according to various embodiments of the present inventive concepts.
Figure 2B:
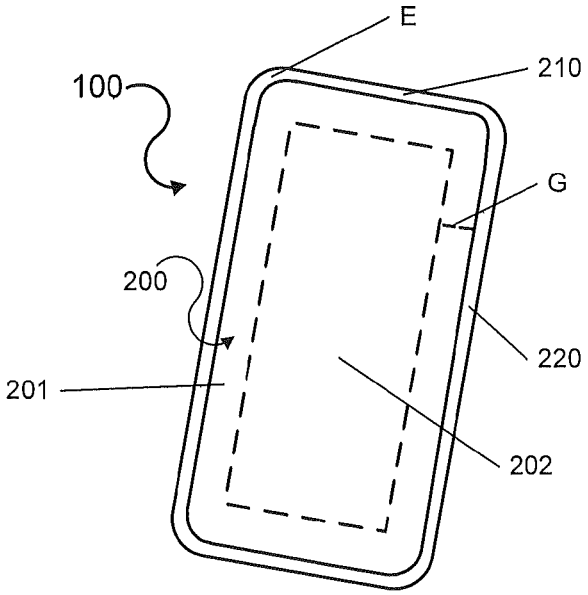

FIGS. 2A and 2B illustrate front and rear views, respectively, of a wireless electronic device 100, according to various embodiments of the present inventive concepts. Accordingly, FIGS. 2A and 2B illustrate opposite sides of the wireless electronic device 100. In particular, FIG. 2B illustrates an external face 201 of a backplate 200 of the wireless electronic device 100. Accordingly, the external face 201 of the backplate 200 may be visible to, and/or in contact with, a user of the wireless electronic device 100. In contrast, an internal face of the backplate 200 may face internal portions of the wireless electronic device 100, such as a transceiver circuit. In some embodiments, the backplate 200 may be a metal backplate.

FIG. 2B further illustrates a first antenna 210 and a second antenna 220 around a ground plane 202 of the wireless electronic device 100. The ground plane 202 may be between the backplate 200 and a front external face (e.g., a display) of the wireless electronic device 100. The first and second antennas 210, 220 may collectively form at least a portion of a metal perimeter around the ground plane 202. In some embodiments, the metal perimeter may form outer surface edges E (e.g., sides) of the wireless electronic device 100. Moreover, the ground connection G may connect the first antenna 210 and/or the second antenna 220 to the ground plane 202.

It will be understood that the wireless electronic device 100 may include more than one ground connection G. Moreover, it will be understood that the wireless electronic device 100 may include more than two antennas and/or that the antennas 210, 220 may include various types of antennas configured for wireless communications. For example, at least one of the antennas 210, 220 may be a multi-band antenna and/or may be configured to communicate cellular and/or non-cellular frequencies.

In some embodiments, the backplate 200 of the wireless electronic device 100 may overlap/cover at least a portion of the antennas 210, 220. For example, if the metal perimeter forms the outer surface edges E, then at least a portion of the antennas 210, 220 may be recessed within a perimeter of the external face 201 of the backplate 200, and may be between the external face 201 of the backplate 200 and a front external face (e.g., a display) of the wireless electronic device 100. Accordingly, although portions of the antennas 210, 220 may be outside the perimeter of the external face 201 of the backplate 200 (e.g., as illustrated in the rear view of the wireless electronic device 100 provided in FIG. 2B), the antennas 210, 220 may alternatively not be visible at all in the rear view of FIG. 2B or may be partially concealed by the external face 201 of the backplate 200.

Figure 2C:
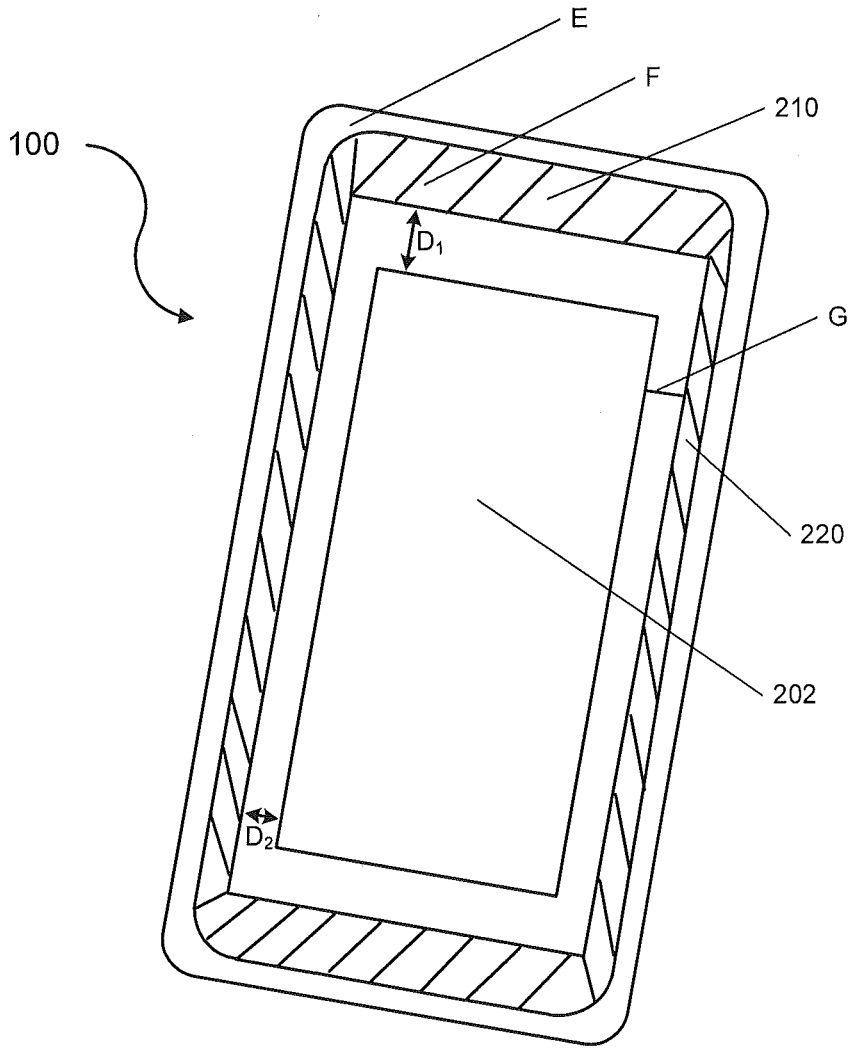
FIG. 2C illustrates a detailed front view of a wireless electronic device, according to various embodiments of the present inventive concepts.

Referring now to FIG. 2C, a detailed front view of a wireless electronic device 100 is illustrated, according to various embodiments of the present inventive concepts. In particular, FIG. 2C illustrates that the metal perimeter including the first and second antennas 210, 220 may form a metal front outer surface F (illustrated with hatched lines in FIG. 2C) of the wireless electronic device 100. FIG. 2C also illustrates the outer surface edges E, which may include an insulative material (e.g., a plastic, glass, ceramic, etc.) and/or a metal material. In embodiments where the outer surface edges E include a metal material, it will be understood that the outer surface edges E and the metal front outer surface F may not be insulated from each other and thus may both radiate communications signals. Moreover, it will be understood that the outer surface edges E and the metal front outer surface F may be substantially perpendicular (e.g., at about a 90-degree angle) to each other. In other words, the metal front outer surface F may be substantially parallel with an outer surface of a display screen of the wireless electronic device 100.

As described with respect to FIG. 2B, the first antenna 210 and/or the second antenna 220 may be connected to the ground plane 202 via the ground connection G. Accordingly, the ground connection G in FIGS. 2B and 2C may be either a connection for only one of the first and second antennas 210, 220 or a connection shared by the first and second antennas 210, 220.

Additionally, in contrast with some conventional wireless electronic devices in which a front metal frame may not be separated from a chassis/ground plane, the metal front outer surface F described herein is spaced apart from the ground plane 202. For example, top and/or bottom end portions of the metal front outer surface F may be spaced apart from adjacent end portions, respectively, of the ground plane 202 by a distance $D_1$ of at least about 4.0-5.0 millimeters (mm). As another example, the side portions of the metal front outer surface F may be spaced apart from adjacent side portions, respectively, of the ground plane 202 by a distance $D_2$ of at least about 1.5-2.0 mm. It will be understood, however, that the distance $D_1$ and/or the distance $D_2$ may be smaller than 4.0 mm and 1.5 mm, respectively, in the absence of an antenna in a portion of the metal front outer surface F adjacent a corresponding portion of the ground plane 202 and/or in the instance of a WiFi-only antenna or another antenna in the metal front outer surface F that can provide good performance with a smaller spacing. Accordingly, the metal front outer surface F may be positioned on the wireless electronic device 100 such that it can provide good multi-band performance using the first and second antennas 210, 220 in the metal front outer surface F.

Figure 3:
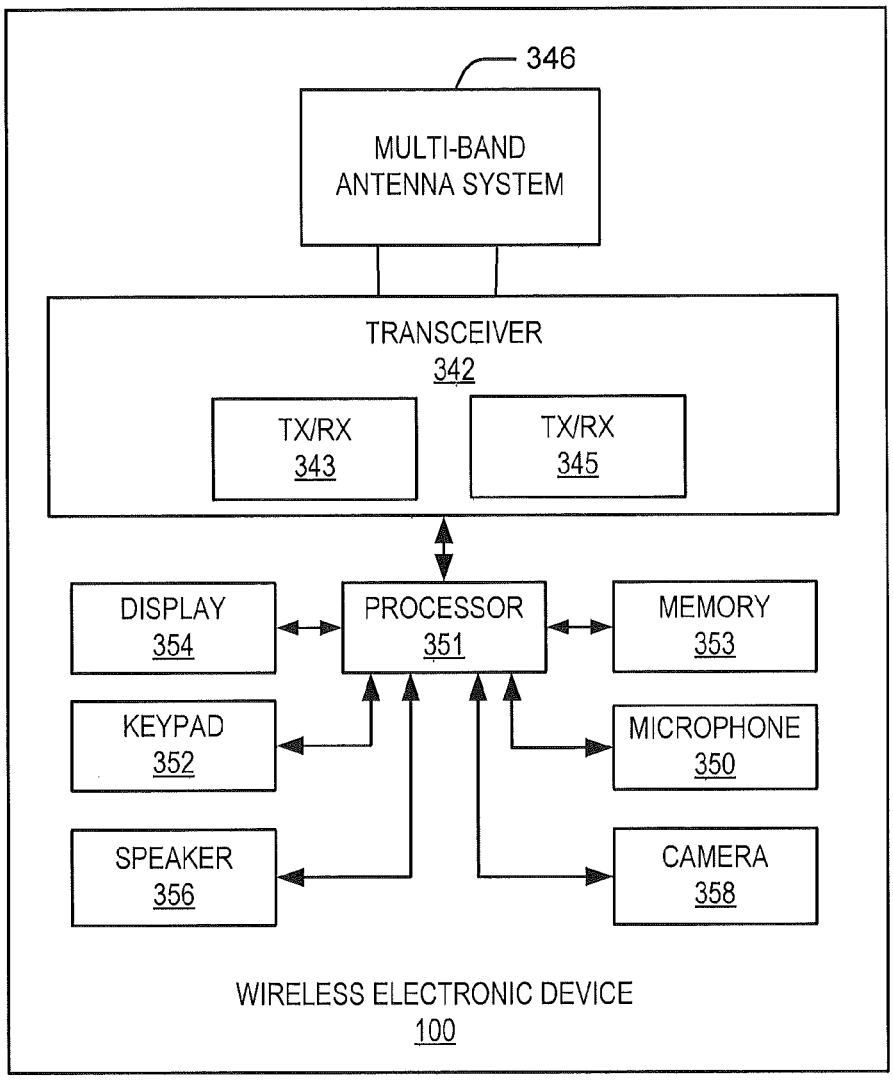
FIG. 3 is a block diagram illustrating a wireless electronic device, according to various embodiments of the present inventive concepts.

Referring now to FIG. 3, a block diagram is provided illustrating a wireless electronic device 100, according to various embodiments of the present inventive concepts. As illustrated in FIG. 3, a wireless electronic device 100 may include a multi-band antenna system 346, a transceiver 342, and a processor 351. The wireless electronic device 100 may further include a display 354, keypad 352, speaker 356, memory 353, microphone 350, and/or camera 358.

A transmitter portion of the transceiver 342 converts information, which is to be transmitted by the wireless electronic device 100, into electromagnetic signals suitable for radio communications (e.g., to the network 110 illustrated in FIG. 1). A receiver portion of the transceiver 342 demodulates electromagnetic signals, which are received by the wireless electronic device 100 from the network 110 to provide the information contained in the signals in a format understandable to a user of the wireless electronic device 100. The transceiver 342 may include transmit/receive circuitry (TX/RX) that provides separate communication paths for supplying/receiving RF signals to different radiating elements of the multi-band antenna system 346 via their respective RF feeds. Accordingly, when the multi-band antenna system 346 includes two active antenna elements (e.g., the antennas 210, 220), the transceiver 342 may include two transmit/receive circuits 343, 345 connected to different ones of the antenna elements via the respective RF feeds.

The transceiver 342, in operational cooperation with the processor 351, may be configured to communicate according to at least one radio access technology in two or more frequency ranges. The at least one radio access technology may include, but is not limited to, WLAN (e.g., 802.11/WiFi), WiMAX (Worldwide Interoperability for Microwave Access), TransferJet, 3GPP LTE (3rd Generation Partnership Project Long Term Evolution), 4G, Time Division LTE (TD LTE), Universal Mobile Telecommunications System (UMTS), Global Standard for Mobile (GSM) communication, General Packet Radio Service (GPRS), enhanced data rates for GSM evolution (EDGE), DCS, PDC, PCS, Code Division Multiple Access (CDMA), wideband-CDMA, and/or CDMA2000. The radio access technology may operate using such frequency bands as 700-800 Megahertz (MHz), 824-894 MHz, 880-960 MHz, 1710-1880 MHz, 1820-1990 MHz, 1920-2170 MHz, 2300-2400 MHz, and 2500-2700 MHz. Other radio access technologies and/or frequency bands can also be used in embodiments according to the inventive concepts. Various embodiments may provide coverage for non-cellular frequency bands such as Global Positioning System (GPS), WLAN, and/or Bluetooth frequency bands. As an example, in various embodiments according to the inventive concepts, the local wireless network 170 (illustrated in FIG. 1) is a WLAN compliant network. In various other embodiments according to the inventive concepts, the local wireless network 170 is a Bluetooth compliant interface.

The wireless electronic device 100 is not limited to any particular combination/arrangement of the keypad 352 and the display 354. As an example, it will be understood that the functions of the keypad 352 and the display 354 can be provided by a touch screen through which the user can view information, such as computer displayable documents, provide input thereto, and otherwise control the wireless electronic device 100. Additionally or alternatively, the wireless electronic device 100 may include a separate keypad 352 and display 354.

It will be understood that the first and second antennas 210, 220 may provide substantial portions of the sides/edges E of the wireless electronic device 100 between the backplate 200 and the display 354. Additionally or alternatively, the first and second antennas 210, 220 may provide substantial portions of the metal front outer surface F described herein.

Figure 5:
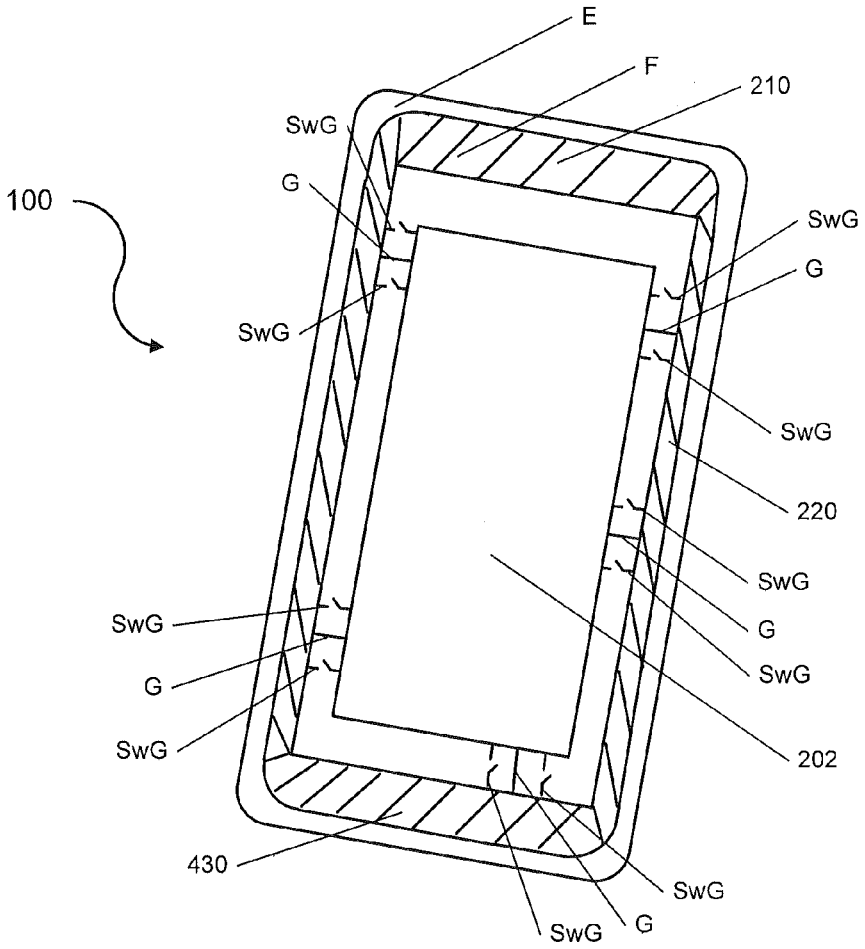
FIG. 5 illustrates a detailed view of a metal perimeter of a wireless electronic device that includes switchable ground connections, according to various embodiments of the present inventive concepts.

Referring still to FIG. 3, the memory 353 can store computer program instructions that, when executed by the processor circuit 351, carry out the operations (e.g., switching of the switchable ground connections SwG illustrated in FIG. 5) described herein and shown in the figures. As an example, the memory 353 can be non-volatile memory, such as EEPROM (flash memory), that retains the stored data while power is removed from the memory 353.

Figure 4A:
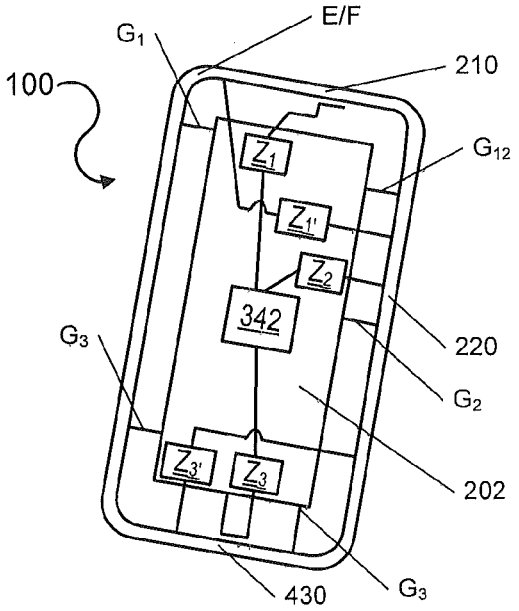
FIGS. 4A-4D illustrate detailed views of a metal perimeter of a wireless electronic device, according to various embodiments of the present inventive concepts.

Referring now to FIGS. 4A-4D, detailed views of a metal perimeter of a wireless electronic device 100 are illustrated, according to various embodiments of the present inventive concepts. For example, FIG. 4A illustrates the ground plane 202 connected to the first and second antennas 210, 220, which, collectively form at least a portion of the metal perimeter. As described with respect to FIG. 2C, the metal perimeter may form the outer surface edges E and/or the metal front outer surface F. The metal perimeter of the wireless electronic device 100 may include a third antenna 430, which may be connected to the ground plane 202 via one or more ground connections $G_3$. As an example, if the third antenna 430 is a half-loop antenna, then the third antenna 430 may be connected to the ground plane 202 via two ground connections $G_3$. The ground plane 202 may be on a printed circuit board, which may include various components of the wireless electronic device 100, such as the transceiver 342, the processor, 351, and/or the memory 353.

It will be understood that more or fewer than the three antennas 210, 220, and 430 may be included in the metal perimeter of the wireless electronic device 100. For example, the metal perimeter may include a fourth antenna in some embodiments. The first through third (or first through fourth, etc.) antennas may be rearranged at different locations of the outer surface edges E and/or the metal front outer surface F. Also, any of the antennas may include a primary cellular antenna, a diversity cellular antenna, a Global Positioning System (GPS) antenna, and/or a WiFi/Bluetooth antenna.

As an example, one or more of the antennas 210, 220, and 430 may be connected to a transceiver circuit (e.g., the transceiver 342 illustrated in FIG. 3). Moreover, any of the antennas 210, 220, and 430 may be a cellular antenna, a non-cellular antenna, or a diversity antenna. For example, the first antenna 210 may be a main/primary cellular antenna. The second antenna 220, on the other hand, may be a Wireless Local Area Network (WLAN)(e.g., 802.11) and/or Bluetooth antenna. For example, the second antenna 220 may be a single-band or dual-band WiFi antenna operating at frequency bands of about 2.4 GHz and/or about 5.0 GHz. The third antenna 430 may be a diversity cellular antenna that may be combined with a non-cellular application such as GPS. It will be understood, however, that the third antenna 430 may alternatively be a main/primary cellular antenna, and that the first antenna 210 may be a diversity cellular antenna and/or a non-cellular antenna.

Referring still to FIG. 4A, each of the first, second, and third antennas 210, 220, and 430 may be connected to a radio/source transceiver. As an example, each of the first, second, and third antennas 210, 220, and 430 may be connected to the transceiver circuit 342 of FIG. 3. The transceiver circuit 342 may include respective transceivers (e.g., the transceivers 343, 345, etc.) configured to provide communications using the first, second, and third antennas 210, 220, and 430. Moreover, it will be understood that one or more of the respective transceivers may be separate transceiver circuits that are not included in the transceiver circuit 342.

Each of the transceivers corresponding to the first, second, and third antennas 210, 220, and 430 may be connected to a matching circuit. For example, the first, second, and third antennas 210, 220, and 430 may be electrically and/or physically coupled to the matching circuits $Z_1$, $Z_2$, and $Z_3$, respectively. The matching circuits may each be the same type of matching circuit or may be different types of matching circuits. For example, the matching circuit $Z_1$ may provide a capacitive feed for the first antenna 210. In other words, the matching circuit $Z_1$ may be electrically, but not physically, coupled to the first antenna 210. In contrast, the matching circuit $Z_2$ may provide a direct feed for the second antenna 220. In another example, the matching circuit $Z_3$ may provide an inductive feed (which is physically connected to the ground plane 202) for the third antenna 430. It will be understood, however, that the first antenna 210 may alternatively use an inductive feed or a direct feed, and/or that the third antenna 430 may alternatively use a capacitive feed or a direct feed, and/or that the second antenna 220 may use an inductive or capacitive feed.

According to various embodiments, one or more of the antennas 210, 220, and 430 may be half-loop antennas. In other words, one or more of the antennas 210, 220, and 430 may have ground connections that are spaced apart along the metal perimeter. As an example, the third antenna 430 may have the spaced-apart ground connections $G_3$ that are connected to the ground plane 202. Moreover, adjacent half-loop antennas may share a ground connection. A shared ground connection, as described herein, is a single/same/common ground connection (e.g., physical coupling) to the ground plane 202 and is spaced apart from other ground connections to the ground plane 202. For example, the first antenna 210 and the second antenna 220 may share the ground connection $G_{12}$, which is spaced apart from the ground connections $G_1$ and $G_2$ that also connect the first and second antennas 210, 220, respectively, to the ground plane 202. Alternatively, the first and second antennas 210, 220 may have only independent (rather than shared) ground connections G, and outer surfaces of the first and second antennas 210, 220 may be physically connected to each other along the metal perimeter by a metal that is between the first and second antennas 210, 220 (e.g., between the independent ground connections G).

As the first and second antennas 210, 220 may be physically connected to each other along the metal perimeter by metal (e.g., by a metal insert/filling or by sharing the ground connection $G_{12}$), it will be understood that the first and second antennas 210, 220 may each include a metal outer surface that physically contacts the metal outer surface of the other antenna. The first and second antennas 210, 220 may thus collectively define an uninterrupted metal outer surface that is a continuously-metal outer surface in the outer surface edges E and/or the metal front outer surface F of the wireless electronic device 100. In other words, respective metal outer surfaces of the first and second antennas 210, 220 may physically connect to provide a combined metal outer surface that only/exclusively includes metal. Accordingly, portions of the outer surface edges E and/or the metal front outer surface F that include a combination of the first and second antennas 210, 220 may be free of non-metal (e.g., plastic, glass, ceramic, etc.) discontinuities and may thus provide a more continuous metal look and/or feel to the exterior of the wireless electronic device 100.

Referring still to FIG. 4A, the matching circuit $Z_{1'}$ may be connected to the first and second antennas 210, 220, and may bypass the transceiver circuit 342, to improve isolation between the first and second antennas 210, 220. For example, the matching circuit $Z_{1'}$ may help the first and second antennas 210, 220 to operate in opposite phase, which may improve isolation even if the first and second antennas 210, 220 are radiating similar frequencies (e.g., WiFi frequencies and LTE Band 7 frequencies). Additionally or alternatively, the matching circuit $Z_{3'}$ may be connected to the third antenna 430 and to a portion of the metal perimeter that is adjacent the third antenna 430, and may bypass the transceiver circuit 342, such that the adjacent portion of the metal perimeter supplements (e.g., by adding bandwidth) radiation by the third antenna 430.

Figure 4B:
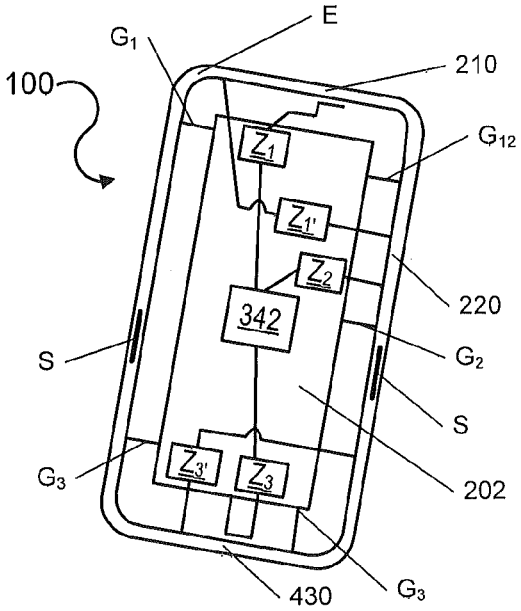

Referring to FIG. 4B, the outer surface edges E of the wireless electronic device 100 may have slots/openings S. The slots/openings S may provide space for an input/output component such as a headphone port/jack, a Universal Serial Bus (USB) port, a high definition audio/video port (e.g., High-Definition Multimedia Interface (HDMI) or Mobile High-Definition Link (MHL)), a Subscriber ID Module (SIM) card, and/or a speaker (e.g., the speaker 356), among others. Additionally or alternatively, the slots/openings S may provide space for buttons such as a camera button, a volume button, and/or a power button. Moreover, although two slots/openings S are illustrated in FIG. 4B, it will be understood that more or fewer slots/openings S may be in the outer surface edges E of the wireless electronic device 100.

Although the slots/openings S may incorporate non-metal materials/components, it will be understood that each of the slots/openings S may be completely surrounded by metal of the metal outer surface edges E. For example, the outer surface edges E may provide metal above, below, and to the sides of the slots/openings S. Accordingly, the outer surface edges E may be continuously metal except for the slots/openings S. The metal surrounding the slots/openings S may thus provide a more continuous metal look and/or feel to the exterior of the wireless electronic device 100. Moreover, whereas the first and second antennas 210, 220 have a shared ground connection $G_{12}$, the third antenna 430 illustrated in FIG. 4B is separated from the first and second antennas 210, 220 along the metal perimeter by the slots/openings S (which may be physically coupled to the ground plane 202) and thus does not share a ground connection with either of the first and second antennas 210, 220. It will be understood, however, that the first and second antennas 210, 220 may alternatively be spaced apart along the metal perimeter and physically connected to each other by metal, such as by a metal insert/filling.

Figure 4C:
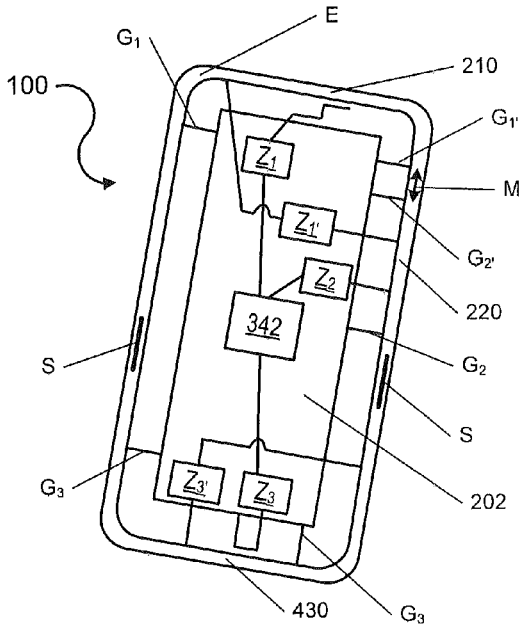
Figure 4D:
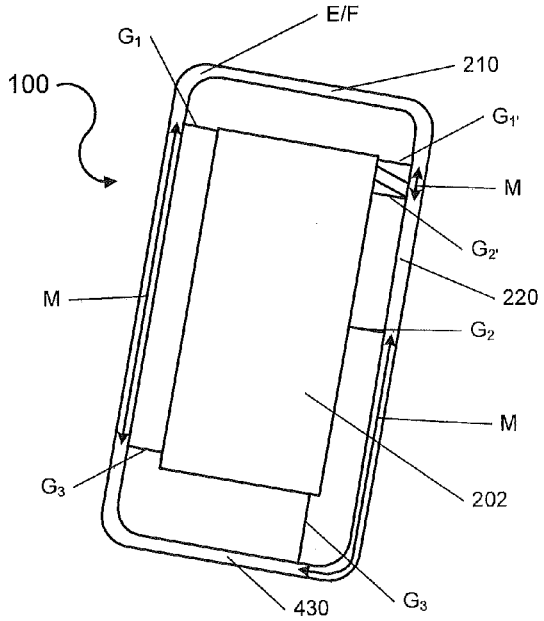

Referring now to FIGS. 4C and 4D, the first and second antennas 210, 220 may be spaced apart along the metal perimeter and physically connected to each other by a metal M, which may be a metal insert/filling, among other forms of metal elements. For example, if the wireless electronic device 100 has relatively large display screen, then gaps may exist between the antennas 210, 220, and 430 in the relatively large metal perimeter, and the gaps may be bridged/filled by metals M. As an example, instead of using the shared ground connection $G_{12}$ in addition to the respective ground connections $G_1$ and $G_2$, the first and second antennas 210, 220 may be physically and/or electrically coupled to the ground plane 202 by ground connections $G_1$ and $G_{1'}$ and $G_2$ and $G_{2'}$, respectively. Moreover, the metal M may bridge a gap between the ground connections $G_{1'}$ and $G_{2'}$, thus connecting the outer surfaces of the first and second antennas 210, 220 by metal. By physically connecting outer surfaces of the first and second antennas 210, 220 via the metal M rather than with an insulative material, the outer surface of the metal perimeter of the wireless electronic device 100 may have a more continuous metal look and/or feel.

Moreover, as illustrated by the hatched lines in FIG. 4D, in some embodiments, the metal M may be filled in a gap between the first and second antennas 210, 220 to contact the ground plane 202, as well as to provide a metal outer surface in the metal perimeter. Alternatively, although the metal M may provide the outer surface of the metal perimeter between the first and second antennas 210, 220, the hatched lines in FIG. 4D may represent an insulative material between the metal M and the ground plane 202. Additionally, it will be understood that the ground plane 202 illustrated in FIG. 4D may include the transceiver 342 and the matching circuits $Z_1$-$Z_3$ illustrated in FIGS. 4A-4C.

Referring now to FIG. 5, a detailed view of a metal perimeter of a wireless electronic device 100 that includes switchable ground connections SwG is illustrated, according to various embodiments of the present inventive concepts. In particular, FIG. 5 is an illustration of switchable ground connections SwG for the wireless electronic device 100 illustrated in FIG. 2C. The switchable ground connections SwG may adjust/change the length of the antennas 210, 220, and 430. For example, the antennas 210, 220, and 430 may be half-loop antennas, and adjusting the length of the half-loop antennas may provide more precise tuning to frequency bands of interest. For example, using a switchable ground connection SwG to shorten the length of a half-loop antenna may help to tune the half-loop antenna to higher frequencies. Moreover, it will be understood that the switchable ground connections SwG may be electrically and/or physically connected to matching circuits (e.g., the matching circuits $Z_1$-$Z_3$ illustrated in FIG. 4A) of the wireless electronic device 100.

It will be understood that the switchable ground connections SwG may be arranged anywhere along the metal front outer surface F. In some embodiments, each of the permanent ground connections G may be adjacent one or more switchable ground connections SwG. For example, if the antennas 210, 220, and 430 are half-loop antennas, each of the half-loop antennas may have a permanent ground connection G at/on each end of its half-loop, with a switchable ground connection SwG adjacent each side of the permanent ground connection G. Moreover, although one or more of the antennas 210, 220, and 430 may be half-loop antennas, it will be understood that the wireless electronic device 100 may also include any antenna type/configuration different from half-loop antennas. For example, the first and second antennas 210, 220 may be half-loop antennas in a continuous/seamless metal perimeter of the metal front outer surface F and/or the metal outer surface edges E, and another antenna elsewhere (e.g., outside of the continuous/seamless metal perimeter) in the wireless electronic device 100 may be a monopole antenna or a planar inverted-F antenna (PIFA), among other antennas.

Figure 6:
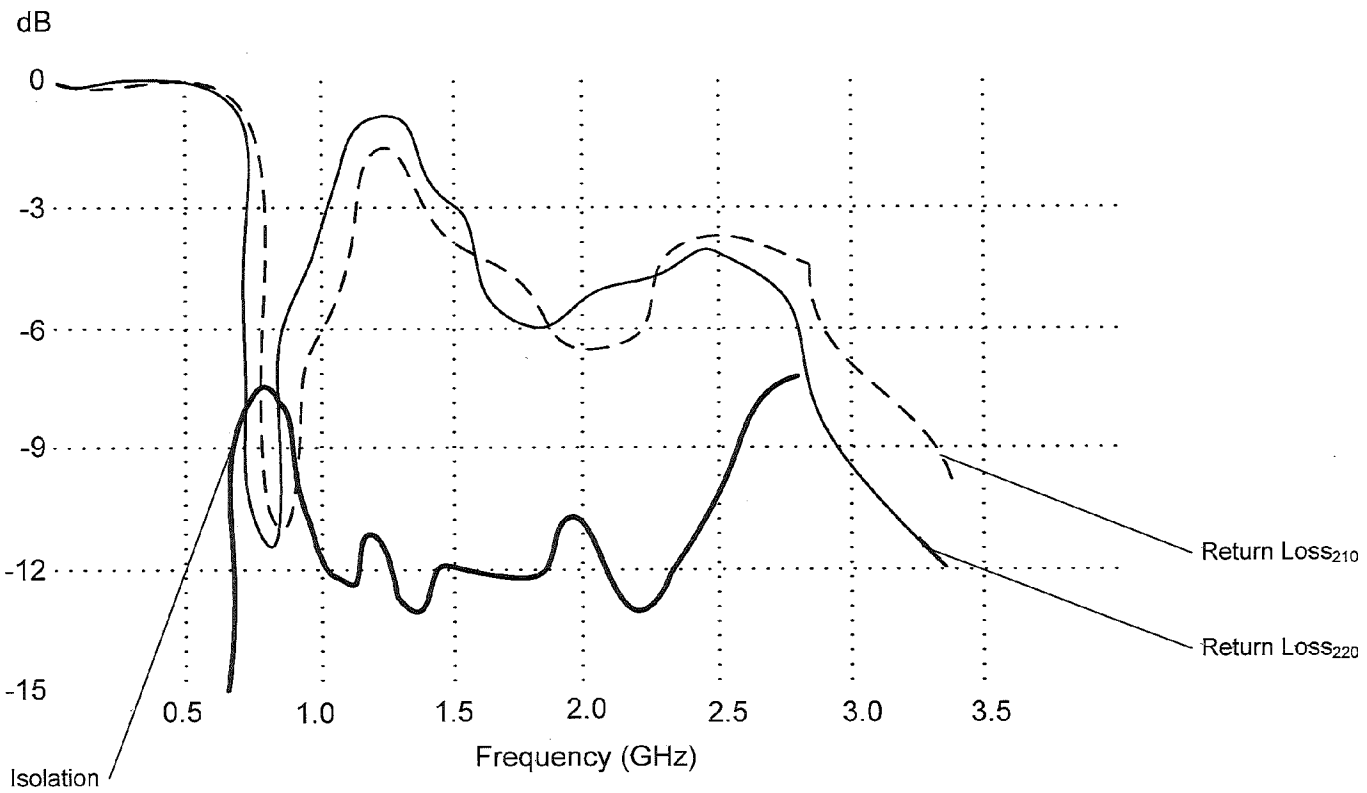
FIG. 6 illustrates S-parameters of antennas of a wireless electronic device, according to various embodiments of the present inventive concepts.

Referring now to FIG. 6, S-parameters of antennas of a wireless electronic device 100 are illustrated, according to various embodiments of the present inventive concepts. In particular, FIG. 6 illustrates three curves. The first curve (Return $Loss_{210}$) illustrates the return loss (e.g., energy absorption) of the first antenna 210. The second curve (Return $Loss_{220}$) illustrates the return loss of the second antenna 220. The third curve (Isolation) illustrates the isolation between the first and second antennas 210, 220.

The Return $Loss_{210}$ and Return $Loss_{220}$ curves of FIG. 6 illustrate that the first and second antennas 210, 220 in the metal front outer surface F can provide good performance for various cellular and non-cellular frequencies. As an example, the first and second antennas 210, 220 illustrated in FIG. 2C can provide return loss better than about −4 decibels (dB) for various frequencies. In particular, the first and second antennas 210, 220 in the metal front outer surface F that is spaced apart from the ground plane 202 may provide performance characteristics similar to what an antenna configuration in the outer surface edges E (e.g., as illustrated in FIG. 2B) would provide. Moreover, although the performance of the first antenna 210 may be very similar to the performance of the second antenna 220, it will be understood that a performance difference between the first and second antennas 210, 220 may be a few dB if one of the first and second antennas 210, 220 is a diversity antenna. Additionally, the Isolation curve illustrates that the first and second antennas 210, 220 in the metal front outer surface F have relatively good isolation (e.g., better than about −9 dB) with respect to each other for various frequencies.

Various embodiments described herein provide a more continuous metal look and/or feel to the exterior of the wireless electronic device 100. Moreover, in some embodiments, the metal front outer surface F may be spaced apart from the ground plane 202 to add functionality to the metal frame/exterior of the wireless electronic device 100 while providing good performance characteristics.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device comprising:

a ground plane;

a metal front outer surface comprising a metal perimeter around and spaced apart from the ground plane, the metal perimeter comprising first and second half-loop antennas that are physically connected to each other along the metal perimeter by metal, wherein the first half-loop antenna comprises a metal outer surface that physically contacts a metal outer surface of the second half-loop antenna to collectively define a continuously metal outer surface along the metal front outer surface; and a transceiver circuit coupled to at least one of the first and second half-loop antennas and configured to provide communications for the wireless electronic device.

2. A wireless electronic device, comprising:

a ground plane; and a metal perimeter around the ground plane, the metal perimeter comprising first and second antennas that are physically connected to each other along the metal perimeter by metal, wherein the first antenna comprises a metal outer surface that physically contacts a metal outer surface of the second antenna.

3. The wireless electronic device of claim 2, wherein the first and second antennas comprise first and second half-loop antennas, respectively.

4. The wireless electronic device of claim 3, wherein the metal outer surface of the first half-loop antenna contacts the metal outer surface of the second half-loop antenna to collectively define a continuously metal outer surface.

5. The wireless electronic device of claim 4, wherein the continuously metal outer surface comprises only metal.

6. The wireless electronic device of claim 2, wherein the metal perimeter comprises a front outer surface of the wireless electronic device, the front outer surface comprising the first and second antennas.

7. The wireless electronic device of claim 6, wherein the front outer surface is spaced apart from the ground plane.

8. The wireless electronic device of claim 7, further comprising:

a backplate; and outer surface edges around the ground plane, wherein the backplate and the front outer surface are separated by the outer surface edges.

9. The wireless electronic device of claim 2, further comprising:

a first transceiver circuit coupled to the first antenna and configured to provide communications for the wireless electronic device;

a second transceiver circuit coupled to the second antenna and configured to provide communications for the wireless electronic device; and an antenna matching circuit connected to the first and/or second antennas and bypassing the first and second transceiver circuits.

10. The wireless electronic device of claim 9, wherein:

the metal perimeter further comprises a third antenna;

at least one of the first and third antennas comprises a cellular antenna; and the second antenna comprises a non-cellular antenna.

11. The wireless electronic device of claim 10, wherein:

the metal perimeter further comprises a slot that provides an opening for a button and/or an input/output component of the wireless electronic device; and the slot is completely surrounded by a metal of the metal perimeter.

12. The wireless electronic device of claim 11, wherein:

the slot comprises one slot among a plurality of slots in the metal perimeter; and the metal perimeter is continuously metal except for the plurality of slots.

13. A wireless electronic device comprising:

a ground plane;

a metal front outer surface comprising a metal perimeter around and spaced apart from the ground plane, the metal perimeter comprising first and second antennas;

a backplate;

outer surface edges around the ground plane, wherein the backplate and the metal front outer surface are separated by the outer surface edges; and a transceiver circuit coupled to at least one of the first and second antennas and configured to provide communications for the wireless electronic device.

14. The wireless electronic device of claim 13, further comprising a switchable ground connection configured to switchably couple the ground plane and one of the first and second antennas to adjust a length of the one of the first and second antennas.

15. The wireless electronic device of claim 14, wherein the first and second antennas comprise first and second half-loop antennas, respectively.

16. The wireless electronic device of claim 15, wherein the metal perimeter of the metal front outer surface further comprises a third antenna.

17. A wireless electronic device comprising:

a ground plane;

a metal front outer surface comprising a metal perimeter around and spaced apart from the ground plane, the metal perimeter comprising first and second antennas; and a transceiver circuit coupled to at least one of the first and second antennas and configured to provide communications for the wireless electronic device, wherein an end portion of the metal perimeter of the metal front outer surface is spaced apart from an adjacent end portion of the ground plane by about 4.0 mm and a side portion of the metal perimeter of the metal front outer surface is spaced apart from an adjacent side portion of the ground plane by about 1.5 mm.

* * * * *